US011262167B2

(12) United States Patent
Ding et al.

(10) Patent No.: US 11,262,167 B2
(45) Date of Patent: Mar. 1, 2022

(54) QUICK MOUNT FOR A RAIL

(71) Applicant: Leapers, Inc., Livonia, MI (US)

(72) Inventors: Tai-lai Ding, Northville, MI (US); Tat Shing Yu, Plymouth, MI (US)

(73) Assignee: Leapers, Inc., Livonia, MI (US)

( * ) Notice: Subject to any disclaimer, the term of this patent is extended or adjusted under 35 U.S.C. 154(b) by 1065 days.

(21) Appl. No.: 15/886,937

(22) Filed: Feb. 2, 2018

(65) Prior Publication Data

US 2019/0242677 A1 Aug. 8, 2019

(51) Int. Cl.
*F41G 11/00* (2006.01)

(52) U.S. Cl.
CPC ..... *F41G 11/003* (2013.01)

(58) Field of Classification Search
CPC ..... F16B 2200/20; F16B 2200/205; F16B 2200/40; F16B 2/06; F16B 2/10; F16B 2/18; F16B 2/185; F41G 11/003; F41G 11/004
See application file for complete search history.

(56) References Cited

U.S. PATENT DOCUMENTS

| | | | | |
|---|---|---|---|---|
| 6,622,980 | B2 * | 9/2003 | Boucher | F16B 2/185 248/231.51 |
| D494,471 | S | 8/2004 | Chou | |
| D505,328 | S | 5/2005 | Chou | |
| 6,922,934 | B1 * | 8/2005 | Huan | F41G 11/003 42/127 |
| D510,120 | S | 9/2005 | Ding | |
| D511,365 | S | 11/2005 | Ding | |
| D513,056 | S | 12/2005 | Ding | |
| D513,298 | S | 12/2005 | Ding | |
| D513,299 | S | 12/2005 | Ding | |

(Continued)

FOREIGN PATENT DOCUMENTS

| | | | |
|---|---|---|---|
| EP | 2520894 | A1 | 7/2012 |
| WO | 2013082274 | A1 | 6/2013 |

OTHER PUBLICATIONS

Leapers, Inc. UTG 400 Luman Everyday Defense LED L-light downloaded from https://www.leapers.com/index.php?act=prod_detail&midx=988&allids=988&itemno=LT-EL223HL-A on Nov. 27, 2017.

(Continued)

*Primary Examiner* — Jonathan P Masinick
(74) *Attorney, Agent, or Firm* — Warner Norcross + Judd LLP

(57) ABSTRACT

A quick mount for removably attaching an accessory to a longitudinal rail, the mount including a base having a first leg with a first undercut wall that engages a first longitudinal rail surface, a second leg opposite the first undercut wall, a retention plate rotatably mounted to the base adjacent the second leg and a bias element. The retention plate is operable in a secure mode in which the bias element urges the retention plate to rotate and engage a second undercut wall of the plate against a second longitudinal rail surface opposite the first surface and thereby clamp the mount to the rail. The retention plate is operable in a release mode where the second undercut wall disengages the second surface thereby releasing the mount from the rail. The mount can include a toggle lock to lock the plate in the secure mode. A related method is provided.

18 Claims, 8 Drawing Sheets

(56) References Cited

U.S. PATENT DOCUMENTS

| | | | | |
|---|---|---|---|---|
| D513,633 | S | 1/2006 | Ding | |
| D516,157 | S | 2/2006 | Ding | |
| D594,084 | S | 6/2009 | Mayberry et al. | |
| D638,089 | S | 5/2011 | Ding | |
| D639,376 | S | 6/2011 | Ding | |
| D641,450 | S | 7/2011 | Ding | |
| D648,413 | S | 11/2011 | Mayberry et al. | |
| D649,993 | S | 12/2011 | Ding | |
| D654,552 | S | 2/2012 | Wu et al. | |
| D659,221 | S | 5/2012 | Wu et al. | |
| D672,839 | S | 12/2012 | Ding | |
| 8,397,421 | B2 | 3/2013 | Ding et al. | |
| 8,429,843 | B2 | 4/2013 | Yan | |
| 8,437,079 | B2 | 5/2013 | Wu | |
| 8,490,313 | B2 * | 7/2013 | Frascati | F41G 11/003 42/90 |
| 8,499,484 | B2 * | 8/2013 | Schneider | F41G 11/003 42/124 |
| D692,516 | S | 10/2013 | Yan et al. | |
| D705,890 | S | 5/2014 | Fitzpatrick et al. | |
| 8,752,325 | B2 | 6/2014 | Ding et al. | |
| D711,492 | S | 8/2014 | Yan et al. | |
| 8,806,792 | B2 | 8/2014 | Yan et al. | |
| 8,813,412 | B2 * | 8/2014 | Rorick | F41G 11/003 42/124 |
| D726,278 | S | 4/2015 | Ding et al. | |
| D727,455 | S | 4/2015 | Ding et al. | |
| D728,728 | S | 5/2015 | Barfoot et al. | |
| D730,474 | S | 5/2015 | Ding et al. | |
| 9,085,900 | B2 * | 7/2015 | Haddock | F16B 5/0685 |
| 9,169,958 | B2 | 10/2015 | Yan | |
| D751,663 | S | 3/2016 | Ding et al. | |
| D755,342 | S | 5/2016 | Ding et al. | |
| D758,521 | S | 6/2016 | Ding et al. | |
| D758,522 | S | 6/2016 | Ding et al. | |
| D771,218 | S | 11/2016 | Ding et al. | |
| D773,005 | S | 11/2016 | Ding et al. | |
| 9,951,904 | B2 * | 4/2018 | Perez | A61G 13/101 |
| 10,030,939 | B2 * | 7/2018 | Kowalczyk, Jr | F41G 11/003 |
| 10,041,765 | B2 * | 8/2018 | McMakin | F41G 1/38 |
| 10,107,596 | B2 * | 10/2018 | Greenwood | F41G 11/003 |
| 10,808,741 | B2 * | 10/2020 | Ahnert | B25B 5/08 |
| 2006/0075674 | A1 | 4/2006 | Ding | |
| 2007/0277422 | A1 | 12/2007 | Ding | |
| 2011/0290968 | A1 * | 12/2011 | Maughan | F41G 11/004 248/231.51 |
| 2012/0281278 | A1 | 11/2012 | Wu | |
| 2013/0312309 | A1 | 11/2013 | Rorick | |
| 2015/0300386 | A1 * | 10/2015 | Fong | F16M 11/041 24/505 |
| 2018/0053607 | A1 | 2/2018 | McCauley et al. | |
| 2021/0154074 | A1 * | 5/2021 | Shetty | F16B 2/10 |

OTHER PUBLICATIONS

Leapers, Inc. UTG New Gen 400 Lumen Compact Grip Light with QD Mount downloaded from https://www.leapers.com/index.php?act=prod_detail&midx=988&allids=988&itemno=MNT-EL223GPQ-A on Nov. 27, 2017.

Leapers, Inc. UTG New Gen 400 Lumen Grip Light with QD Mounting Base downloaded from https://www.leapers.com/index.php?act=prod_detail&midx=988&allids=988&itemno=MNT-EL228GPQ-A on Nov. 27, 2017.

Leapers, Inc. UTG Flashlights and Lasers downloaded from https://www.leapers.com/index.php?act=listproduct&midx=988&allids=988&svroot=MOUNTING%20SYSTEMS on Nov. 27, 2017.

Leapers, Inc. UTG Mounting Systems downloaded from https://www.leapers.com/index.php?act-listproduct&midx=923&allids-918_919_923&svroot-MOUNTING%20SYSTEMS on Nov. 27, 2017.

Leapers, Inc. UTG 4.1" Lowpro Combat Quality QD Lever Mount Metal Foregrip downloaded from https://www.leapers.com/index php?act=prod_detail&itemno=MNT-GRP001SQ&midx=1002&allids=1001_1002 on Nov. 27, 2017.

Leapers, Inc. UTG Model 4 Low Profile Flip-up Front Sight MNT-755 dowloaded from https://www.tacticalwholesalers.com/Leapers-Inc-Model-4-Low-Profile-Flip-up-Front-Sight-MNT-755_p_143421.html?gclid=EAIaIQobChMlIYywtYT21wIVB57ACh1IDwmuEAYYAyABEgKbX_D_BwE on Dec. 6, 2017.

Magpul, MBUS Front & Rear Sight Set downloaded from http://www.tomstactical.com/Magpul-MBUS-Gen-II-Front-Rear-Sight-Set-Black_p_74.html on Jan. 5, 2018.

LWRC International, LWRCI Skirmish Sight Set downloaded from https://www.lwrci.com/p-451-day-9-lwrci-skirmish-sight-set.aspx on Jan. 5, 2018.

Diamondhead, Polymer Diamond Integrated Sighting System (with NiteBrite) downloaded from https://www.diamondhead-usa.com/products/polymer-diamond-integrated-sighting-system-with-nitebrite on Jan. 5, 2018.

Precision Reflex Inc., Flip up Front and Rear Sight Package downloaded from https://www.lapolicegear.com/preflex-flip-up-sight-combo.html on Jan. 5, 2018.

Magpul, MBUS Pro Offset Sight—Front downloaded from https://www.magpul.com/products/mbus-pro-offset-sight-front an Jan. 5, 2018.

Troy Industries, Offset Sight Set, M4 Front and Dioptic Rear—FDE downloaded from https://troyind.com/products/offset-sight-set-m4-front-and-dioptic-rear-fde on Jan. 5, 2018.

HQ Issue, HQ Issue 45° Offset Sight Set downloaded from https://www.sportsmansguide.com/product/index/hq-issue-45deg-offset-sight-set?a=1781389 on January 5, 2018.

Dagger Defense, Dagger Defense flip up BUIS 45 degree picatinny rail mounted backup iron sights downloaded from https://daggerdefense.com/?product=dagger-defense-flip-buis-45-degree-picatinny-rail-mounted-backup-iron-sightson Jan. 5, 2018.

* cited by examiner

QUICK MOUNT FOR A RAIL

BACKGROUND OF THE INVENTION

The present invention relates to an apparatus for mounting an accessory device to a rail, and more particularly to a quick detachment mount for a rail on a projectile shooting device such as a firearm.

Many firearms are outfitted with one or more rails to which accessories can be secured. A common type of rail is a picatinny rail that includes opposing outer edges and multiple slots along an upper surface thereof. This type of rail is included on a variety of different rifles, handguns and shotguns, as well as other projectile shooting devices so that corresponding accessories can be mounted thereto.

Most rail accessory mounts utilize fasteners that are installed with tools to secure the accessory to the rail. These mounts include a first wall on one side of a base and a block on another side of the base. The block is secured to the first wall via a threaded fastener. When the threaded fastener is tightened, it draws the block closer to the first wall, thereby clamping the mount to the rail in a generally secure manner.

An issue with such a mount is that it requires tools and time to mount and remove it and the associated accessory. Some manufacturers have attached a camming lever to the fastener. The lever is manually operable to cam a surface against the block and thereby exert the clamping force on the rail to secure the mount to the rail. While this is useful in some applications, the lever can be inadvertently actuated to release the mount and accessory from the rail. Further, such a mount typically can be over tightened or under tightened, providing inconsistent attachment of the mount to the rail. In addition, this cammed lever construction, can require extra dexterity to secure the mount to the rail.

Accordingly, there remains room for improvement in the field of rail mounts to secure accessories to rails of projectile shooting devices.

SUMMARY OF THE INVENTION

A quick mount for removably attaching an accessory to a longitudinal rail is provided. The mount can include a base having a first leg with a first undercut wall or element that engages a first longitudinal rail surface, a second leg opposite the first undercut wall or element, a retention plate rotatably mounted to the base adjacent the second leg and a bias element.

In one embodiment, the retention plate is operable in a secure mode in which the bias element urges the retention plate to rotate and engage a second undercut wall or element of the plate against a second longitudinal rail surface, opposite the first longitudinal rail surface, and thereby clamp the mount to the rail.

In another embodiment, the retention plate is operable in a release mode where the second undercut wall disengages the second longitudinal rail surface thereby releasing the mount from the rail.

In yet another embodiment, the first leg can define a plate recess within which the retention plate is movably disposed. The retention plate can pivot or otherwise rotate at least partially into and out from the recess when engaging and disengaging the longitudinal rail.

In still another embodiment, the base can include a mounting surface adjacent the retention plate. The mounting surface can include one or more overhang walls that extend outward toward a longitudinal axis of the base. These overhang walls can be configured to overlap and secure an accessory mounted to or otherwise associated with the mount. The accessory can vary, depending on the application and use. Examples of some accessories are pressure pad switches, on off toggle switches, lighting systems, aiming lasers, bipods, optical sights, iron sights, cameras, and virtually any other rail mounted accessory.

In a further embodiment, the retention plate can be biased by the bias element to the secure mode. The bias element can urge the upper part of the retention plate away from the base such that the second undercut wall or element is moved toward the longitudinal rail to which the mount is joined. This bias element can be disposed between the base and the retention plate such that it, by default, urges the second undercut wall or element to engage the longitudinal rail. The retention plate can be manually engaged along an upper part thereof to compress the bias element and disengage the second undercut wall or element from the rail, thereby facilitating release of the mount from the rail.

In a further embodiment, the mount can include a toggle lock to lock the retention plate in the secure mode. The toggle lock optionally can be mounted directly to the retention plate and distal from the base. The toggle lock can be pivotally joined with the retention plate.

In yet a further embodiment, the toggle lock can be biased to automatically attain or reset to a locking mode. The toggle lock can be engaged by a lock spring to urge the toggle lock to rotate in a manner such that its exterior surface is offset at an angle from an exterior surface of the retention plate. When the toggle lock is pressed to engage it to an unlocked or free mode, the exterior surface of the toggle lock can be parallel to and/or flush with the exterior surface of the retention plate.

In still a further embodiment, the toggle lock can include a toggle lock head, and the base can include a buttress wall. The toggle lock head can be configured to selectively engage the buttress wall of the base to prevent the retention plate from rotating about the rotation axis. When the lock head engages the buttress wall, the retention plate can be temporarily maintained in the secure mode.

In still another embodiment, a method is provided. The method can include: providing a base including a downward extending first lateral leg and a downward extending second lateral leg; placing a first undercut wall of the first lateral leg under a first lower inwardly extending surface of the longitudinal rail; rotating a retention plate upper part about a rotation axis toward the base to compress a bias element; tilting or otherwise rotating the base so the second lateral leg moves toward a first lower inwardly extending surface of the longitudinal rail, and optionally so that a slot flange enters into a transverse slot of the longitudinal rail so that the base is un-slidable along the longitudinal rail; and releasing the retention plate upper part so that the bias element rotates the retention plate about the rotation axis so that a second undercut wall of the retention plate engages a second lower inwardly extending surface of the longitudinal rail. The longitudinal rail can be clamped between the retention plate and the first lateral leg to thereby secure the mount and an associated accessory to the longitudinal rail.

In still another embodiment, the method can include rotating a toggle lock to engage the base and lock the retention plate in a secure mode in which the retention plate cannot disengage the longitudinal rail.

The current embodiments of the accessory mount and related method of use provide the benefits above that previously have been unachievable. These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

An accessory mount configured to selectively secure an accessory to a longitudinal rail of a projectile shooting device of the current embodiment is illustrated in FIGS. 1-10 and generally designated 10. The accessory mount 10 can be utilized in conjunction with a variety of different accessories. As mentioned above, suitable accessories include, but are not limited to, pressure pad switches, on off toggle switches, lighting systems, aiming lasers, bipods, optical sights, iron sights, cameras, and virtually any other rail mounted accessory. The accessory mount herein will be described in conjunction with mounting a pressure pad switch, which optionally can be in electrical communication with some other electronic device, such as a flashlight or laser, to a longitudinal rail 100. The accessory mount 10 herein is described in conjunction with a longitudinal rail 100 that is joined with or otherwise forms a part of a projectile shooting device, such as a firearm. The longitudinal rail 100 described herein is a picatinny rail, however, any other type of rail or mounting structure is contemplated to be compatible with the mount 10. The present mount can be used with firearms, such as shotguns, handguns, artillery weapons, as well as archery devices, such as compound bows and crossbows or other projectile shooting devices.

Figure 1:
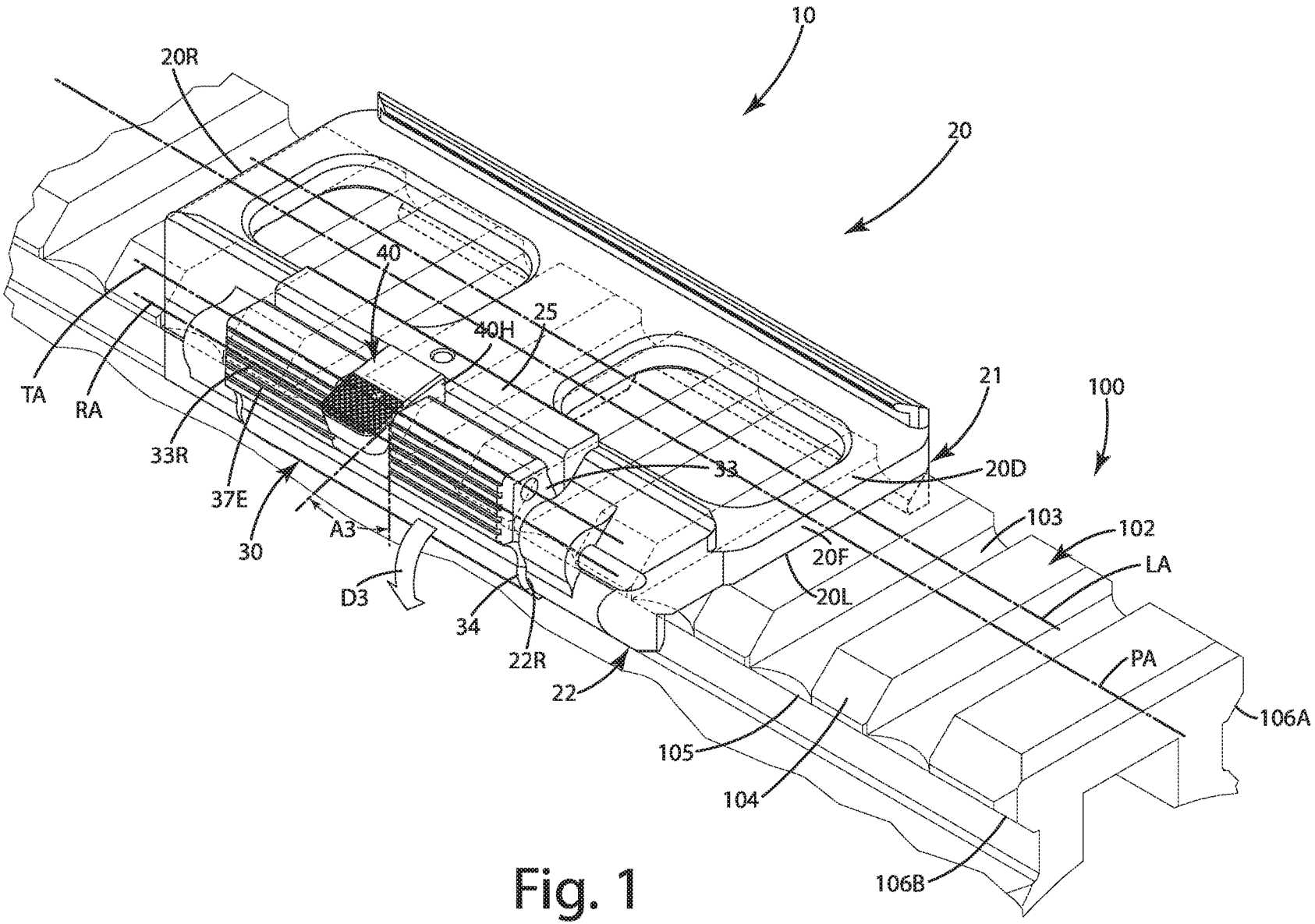
FIG. 1 is a front perspective view of a rail with a mount of a current embodiment thereon, in a closed, locked mode.

With reference to FIG. 1, the mount 10 includes a base 20 and a retention plate 30 shown in a secure mode to join the mount 10 with the longitudinal rail 100. The retention plate is locked in that mode by a toggle lock 40 that itself is in a locked mode. The longitudinal rail 100 has a top surface 102 that defines a plurality of rail slots 103. The top surface can extend toward an outward and downwardly angled upper surface 104 that transitions to an apex 105. From line apex 105, the rail transitions down to a lower inwardly extending surface 106. The rail 100 can include a first lower inwardly extending surface 106A and a second lower inwardly extending surface 106B on opposite sides of the rail axis PA. These services can be engaged by components and structures of the mount 10 is further described below.

With reference to FIGS. 1-4, the mount 10 can include a base 20. The base can include a first lateral leg 21 and a second lateral leg 22. These first and second lateral legs can be disposed opposite one another across a longitudinal axis LA of the mount 10. This longitudinal axis LA can be substantially parallel to the longitudinal axis PA of the rail 100. The base 20 can include a front 20F and a rear 20R at opposite ends of the base 20. The base 20 can include a deck 20D and a lower surface 20L opposite that deck 20D. The deck 20D can be configured so that accessories can be placed on and/or in it, for example, the pressure switch 109 shown in FIGS. 3-4, as described in detail below.

Figure 3:
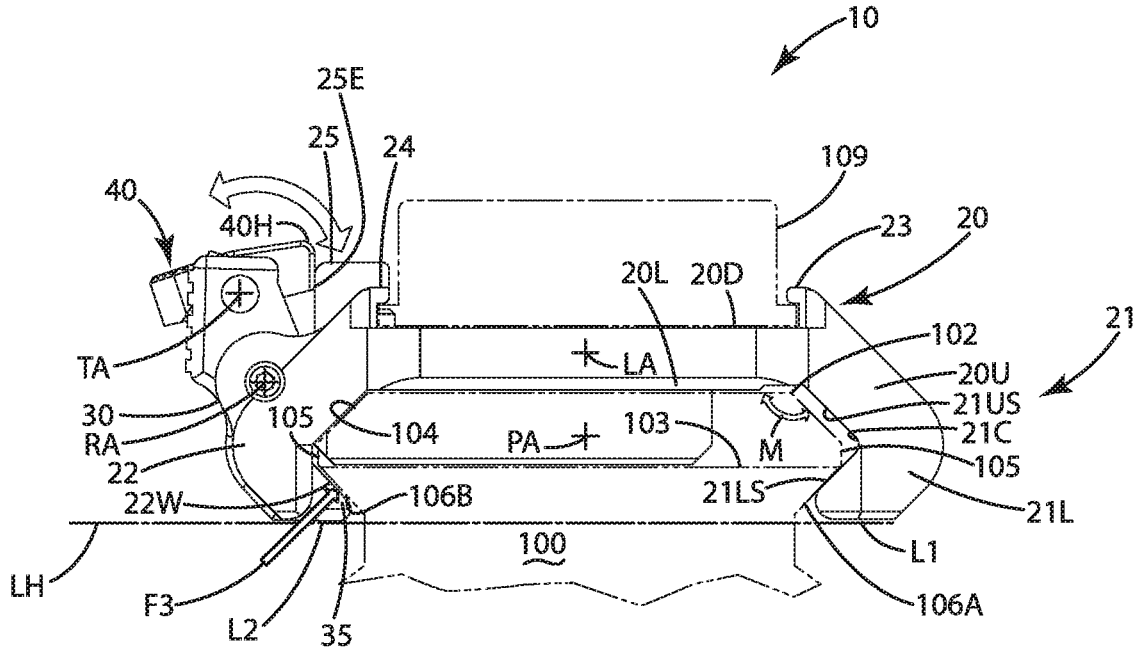
FIG. 3 is a side view of the mount in a closed, locked mode.

With reference to FIGS. 1 and 3, the mount 10 optionally can include first 23 and second 24 overhang walls. The overhang walls can extend partially over the deck 20D. The overhang walls can form recesses under them within which portions 109F of the pressure pad 109 can be slid. These portions of the pressure pad 109 can be flanges 109F or edges that protrude from a main body of the pressure pad. In this manner, these flanges can be secured under the respective overhang walls 23 and 24, which in turn can better secure pressure pad 109 to the deck 20D and the base 20. In some applications, the deck 20D can be outfitted with hook and loop fasteners, connectors, adhesives or other mechanical fasteners to secure the accessory, such as the pressure pad switch 109, to the mount 10. In other applications, the accessory 109 can be directly bolted, fastened, welded to or form an integral part of the base 20.

Figure 5:
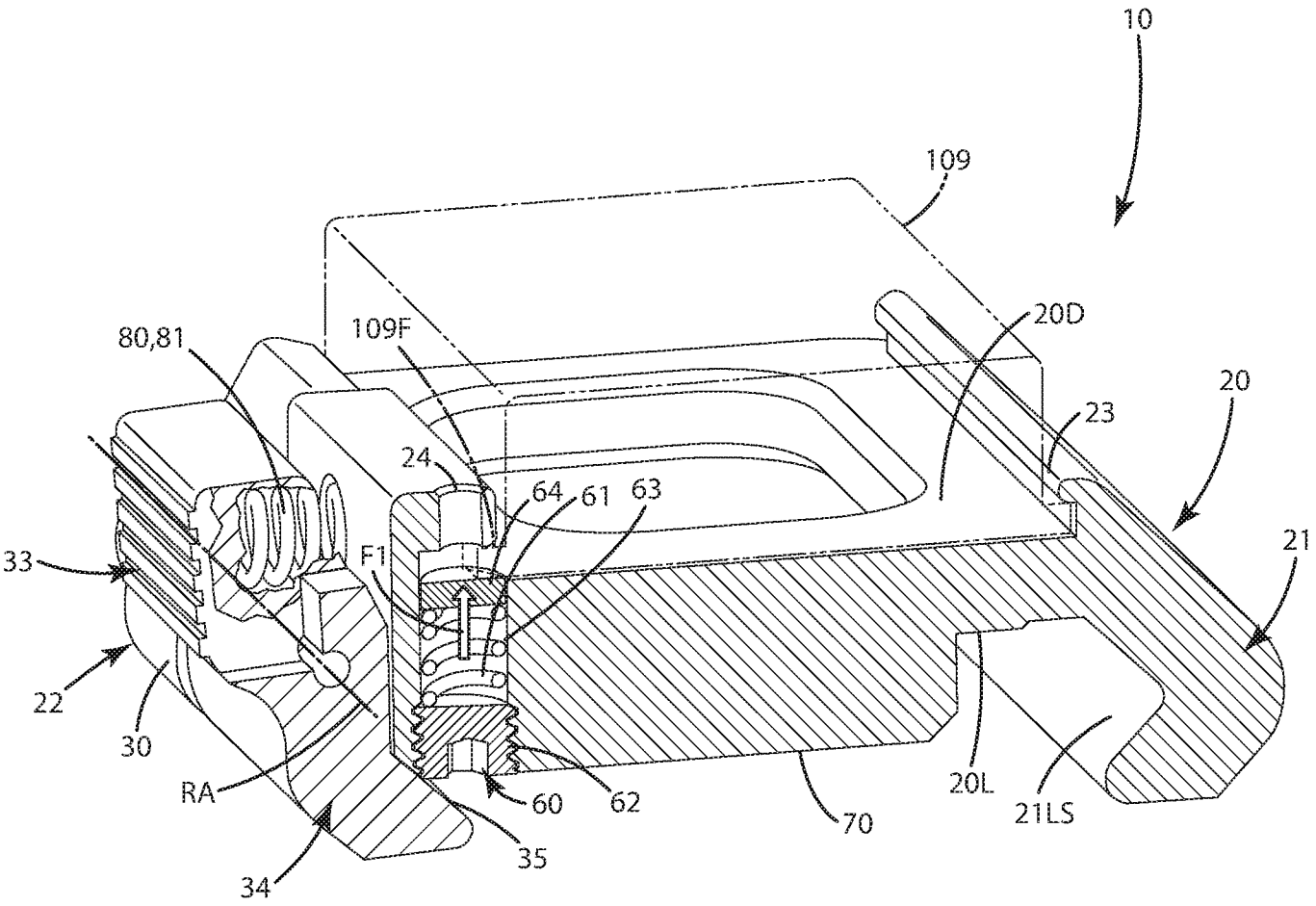
FIG. 5 is a partial section view of the mount illustrating a retention plunger and a spring that urges the retention plate to a closed mode.

As shown in FIG. 5, the base 20 can be outfitted with an accessory holding assembly 60. This accessory holding assembly 60 can include a hole 61 that extends through the deck 20D and an optional slot flange 70. The hole 61 can be threaded and can extend through the deck 20D in a location under at least a portion of the overhang wall 24. The hole 61 can receive a fastener 62, which optionally can be a set screw that is threaded into the hole 61 a predetermined amount. The hole 61 also can receive and retain a plunger spring 63 and a plunger 64. The spring 63 can urge the plunger 64 into the recess below the overhang wall 24, and optionally against the bottom surface of the overhang wall 24. The set screw 62 can be threaded into the hole 61 a predetermined amount so that the plunger 64 can exert a force F1 against a flange 109F of the accessory 109 to thereby pinch or a clamp or otherwise secure that flange 109F in position. Thus, the plunger assembly 60 can assist in maintaining the accessory in engagement with the mount 10. The plunger can be dimensioned so that it does not protrude completely from the deck 20D, and therefore does not become loosened or free under the overhang wall and potentially lost.

As shown in FIGS. 1-5, the base 20 also can include the slot flange 70. The slot flange 70 can fit into one or more of the transverse slots 103 defined by the longitudinal rail 100. The slot flange 70 can extend downwardly from the lower surface 20L opposite the deck 20D. The hole 61 can extend at least partially through this slot flange 70. The slot flange 70 can extend transversely to the longitudinal axis LA of the mount 10 and can be perpendicular to it. The slot flange 70 can extend downward from the bottom of the base, for example from the lower surface 20L between the first and second lateral legs. When the mount 10 is installed on the rail 100, the slot flanged 70 fits within a transverse slot 103. When it acquires this position, it prevents the base 20 and the mount 10 in general from being longitudinally slid along the longitudinal rail 100. Thus, the mount is not slidable relative to the longitudinal rail. Of course, in some applications, the slot flange 70 can be duplicated along the length of the base 20 to provide further securement. In other cases, the slot flange can be completely eliminated so that the mount 10 is slidable along the rail 100 when not in a secured mode. Further, although shown as an integral wall extending downward from the base 20, the slot flange instead can be in the form of a set screw, fastener, or other protuberance extending downward from the base and generally configured to fit within one or more of the transverse slots 103 of the longitudinal rail 100.

With reference to FIG. 3, the base 20 can include the first 21 and second 22 lateral legs. These legs can be structurally different from one another. As shown in FIG. 3, the first lateral leg 21 extends downward, below the lower surface 20L of the deck 20D. The first lateral leg 21 includes an upper portion 21U that extends generally transversely and outwardly away from the longitudinal axis LA at an angle A1 relative to the lower surface 20L. This upper portion 21U includes an inner surface 21US that is configured to be placed adjacent and/or engage the upper surface 104 of the longitudinal rail 100. The upper portion 21U of the first leg 21 transitions to the lower portion 21L. This lower portion 21L includes a first undercut wall or element 21LS that extends inward, toward the longitudinal axis LA. This first undercut wall 21LS transitions to the upper portion surface or wall 21US at a corner 21C. This corner 21C can correspond to a location of an apex 105 of the picatinny. The first undercut wall 21L generally extends under the apex 105 and can follow or mimic the contour of the first lower inwardly extending surface 106 of longitudinal rail 100. The first undercut wall 21L can extend downward to the first lowermost surface L1 of the first lateral leg 21. In some cases, the undercut wall can transition to any rounded or radiused corner to that lowermost surface L1. Optionally, this lowermost surface L1 lays the same level or in the same horizontal plane LH as the second lowermost surface L2 of the second lateral leg 22.

The second lateral leg 22 extends downward, generally below the deck 20D. The second lateral leg 22 can include a second downward extending wall 22W that extends to the second lowermost surface L2. Again, the second lowermost surface L2 can be in the same horizontal level LH as the first lowermost surface L1. This second lateral wall 22W however, can generally be planar and/or flat, or in some cases slightly rounded outward, away from the longitudinal axis LA. This lower wall 22W can be configured so that it does not extend under the second lower inwardly extending surface 106B of the longitudinal rail 100. In this manner, the wall 22W also can clear the apex 105 of the longitudinal rail 100 when the retention plate 30 is in its release mode as described further below, and when the mount 10 is installed on the real 100 and direction D1 or when the mount 10 is removed from the rail in direction D2. These directions can reflect a tilting action of the mount 100 about an axis or region of rotation generally near the first undercut wall 21LS or the apex 105 above that first undercut wall.

Figure 6:
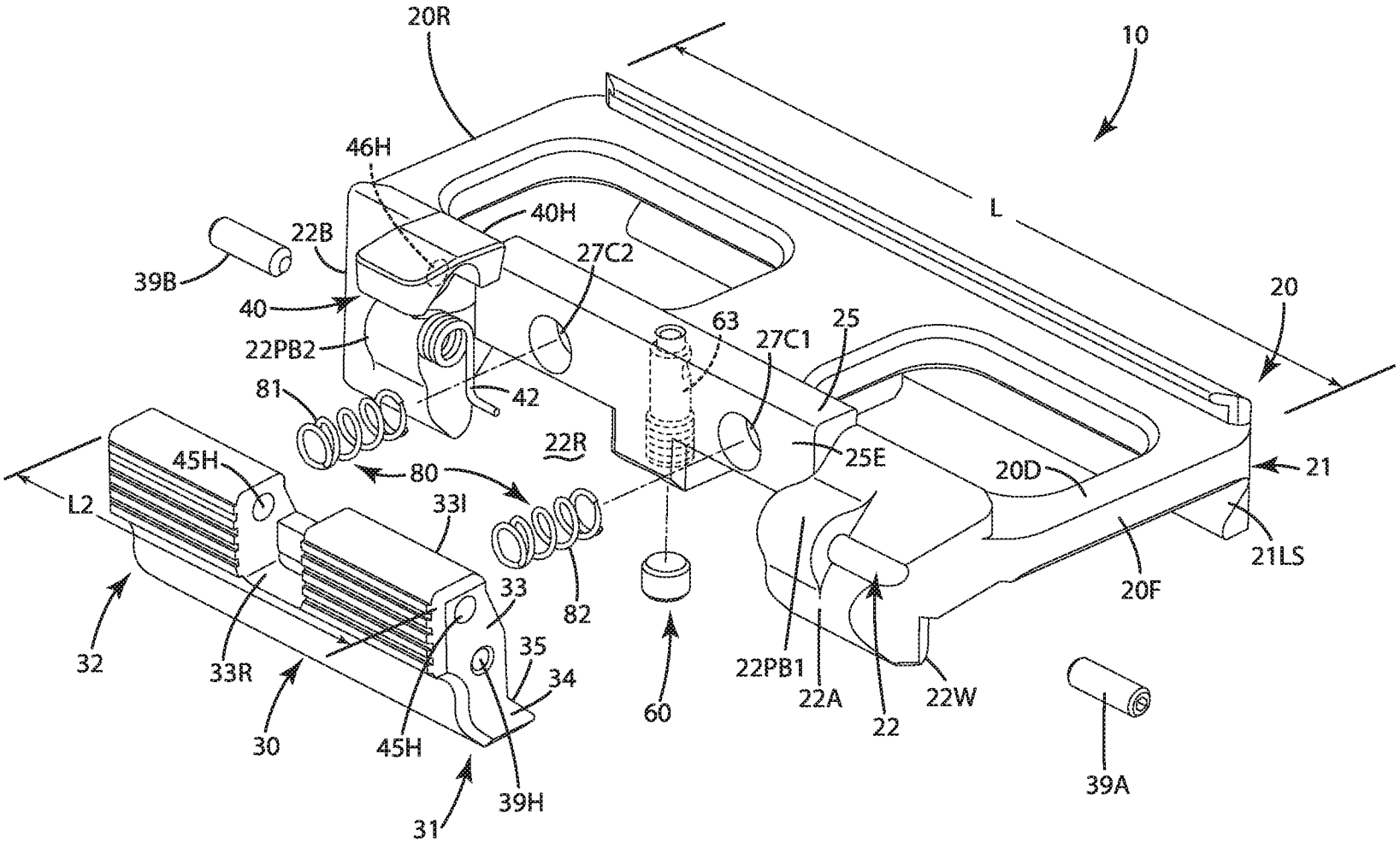
FIG. 6 is an exploded view of the mount.
Figure 7:
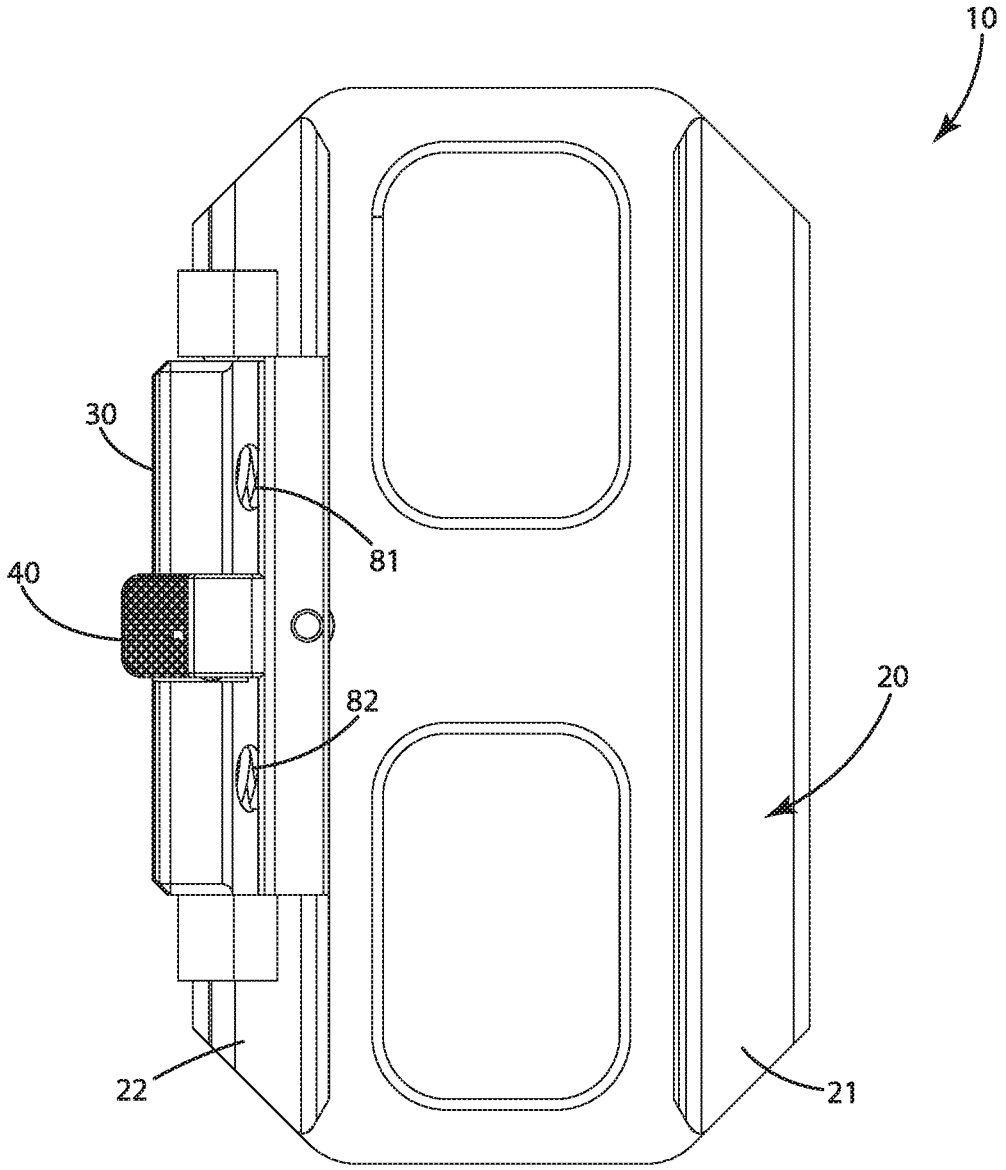
FIG. 7 is top view of the mount in the closed, locked mode.
Figure 8:
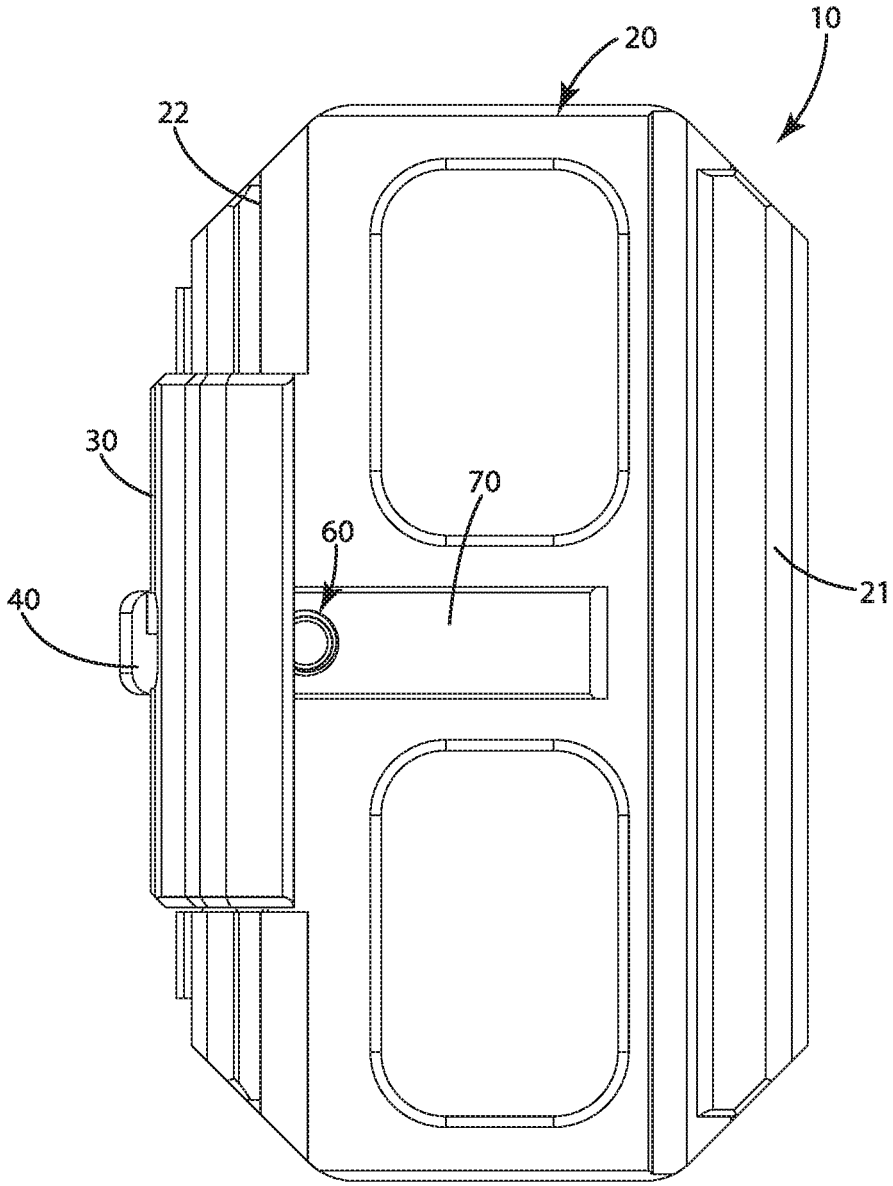
FIG. 8 is bottom view of the mount in the closed, locked mode.
Figure 9:
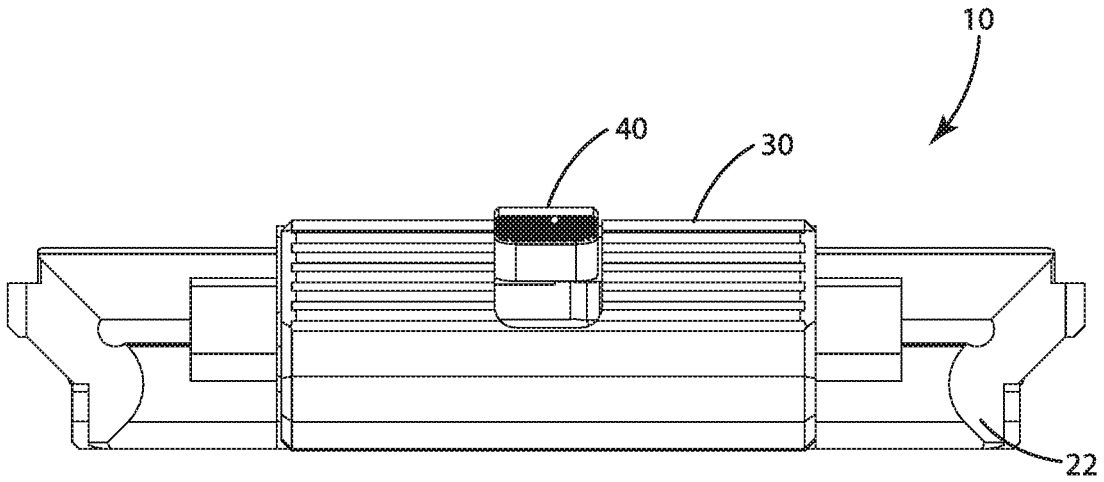
FIG. 9 is right side view of the mount in the closed, locked mode.
Figure 10:
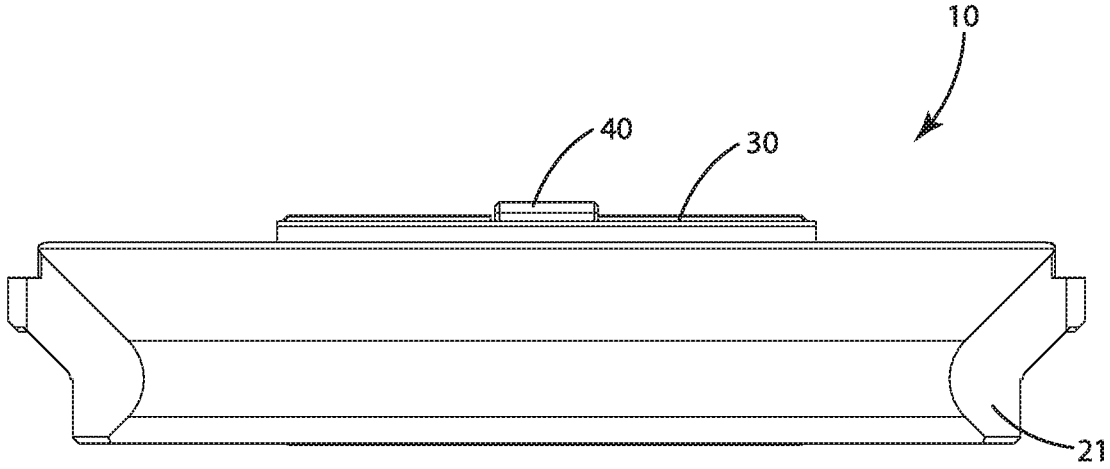
FIG. 10 is left side view of the mount in the closed, locked mode.

As shown in FIGS. 1 and 6, the second lateral leg 22 can be joined to the base 20 adjacent the deck 20D. The second lateral leg 22 can be separated into a forward portion 22A, closer to the front 20F of the base 20, and a second portion 22B, closer to the rear 20R of the base 20. These first and second portions 22A and 22B can define therebetween a plate recess 22R. This plate recess 22R can be configured to receive the retention plate 30 and sized to allow the plate to move relatively freely and/or rotate within the recess 22R. The plate recess 22R can extend a majority of the length L of the mount 10, optionally greater than 50%, further optionally greater than 60%, yet further optionally greater than 75% the length L of the mount 10. The first and second portions 22A and 22B of the second lateral leg 22 can include pillow blocks 22PB1 and 22PB2 disposed on the different portions 22A and 22B. These pillow blocks can receive pivot pins 39A and 39B which can extend into respective pivot pin holes 39H on the first 31 and second 32 ends of the retention plate 30. These pins can act as axles to enable the retention plate to rotate about the rotation axis RA, transitioning to and from the secure mode and the release mode as described below.

The second lateral leg 22 can include, form and/or otherwise transition to a buttress wall 25 that extends upwardly, optionally above the deck 20D of the base 20. This buttress wall 25 can include engagement surface 25E that extends upward from the base 20 and/or deck 20D. This engagement surface 25E can be disposed opposite the overhang wall 24. The buttress wall can extend the length of the plate recess 22R and can engage a portion or the full length L2 of the plate 30 when the plate 30 is in the release mode shown in FIG. 2. Alternatively, when the plate 30 is in the secure mode, and the toggle lock 40 is in its locking mode as shown in FIG. 1, the engagement surface 25E of the buttress wall 25 only engages the head 40H instead of the plate 30 itself.

With reference to FIGS. 1, 3 and 6, the mount 10 can include the retention plate 30. The retention plate 30 can be joined to the base 20 with the retention pins 39A and 39B mentioned above. The retention plate 30 can be joined directly to the second lateral leg 22 and disposed within the recess 22R. The retention plate 30 can be rotatable about the rotation axis RA. This rotation axis RA can be parallel to a longitudinal axis LA of the base and generally parallel to the longitudinal axis PA of the rail. As mentioned further below, the rotational axis RA can also be parallel to the lock axis TA about which the toggle lock about which the toggle lock 40 rotates.

The retention plate 30 can include a retention plate upper part 33 and a lower part 34. The upper part 33 can extend outwardly, generally above the holes 39H and generally above the rotation axis RA of the plate 30. The retention plate upper part 33 can be movably disposed in the plate recess 22R of the second lateral leg 22. The retention plate upper part 30 also can include an inner wall 331. This inner wall 331 can engage the engagement wall 25E of the buttress wall 25 when the plate 30 is in the release mode shown in FIG. 2. In some cases, the inner wall 331 directly engages and contacts that wall 25E. In other cases it merely is placed adjacent to the wall 25E.

The retention plate upper part 33 can include a manual engagement region 37E. This region is shown to include a plurality of ridges, bumps or other tactile structures or textures. When a user engages this manual engagement region 37E, the user can rotate the plate 30 about the rotation axis RA, optionally compressing and/or expanding the bias elements 81 and 82 is described below. In some cases, this manual engagement region 37E can extend into the plate lower part 34.

With reference to FIGS. 5-6, the retention plate upper part 33 can be configured to engage one or more bias elements 81, 82. These bias elements can be disposed between the base 20 and the retention plate 30. More specifically, the bias elements 81 and 82 can be disposed between the buttress wall 25 and/or the second lateral leg 22, and the opposing retention plate upper part 33. The bias elements can be spatially disposed above the rotation axis RA. The bias elements can be configured to urge the retention plate upper part 33 away from the base, for example, the buttress wall 25 and around the rotation axis RA. The buttress wall, base and/or second lateral leg can define respective recesses or spring holes 27C1 and 27C2 that receive the respective bias elements. Likewise, the retention plate can include corresponding recesses or spring holes to house and trap the other end of the bias elements 81, 82. These bias elements as shown can be in the form of coil springs. Of course other types of bias elements, such as leaf springs, elastomeric elements, opposing polar magnets and the like can be used as bias elements to generally bias against the retention plate to urge the second undercut wall or other element 35 against the longitudinal rail inwardly extending surface 106B.

Figure 2:
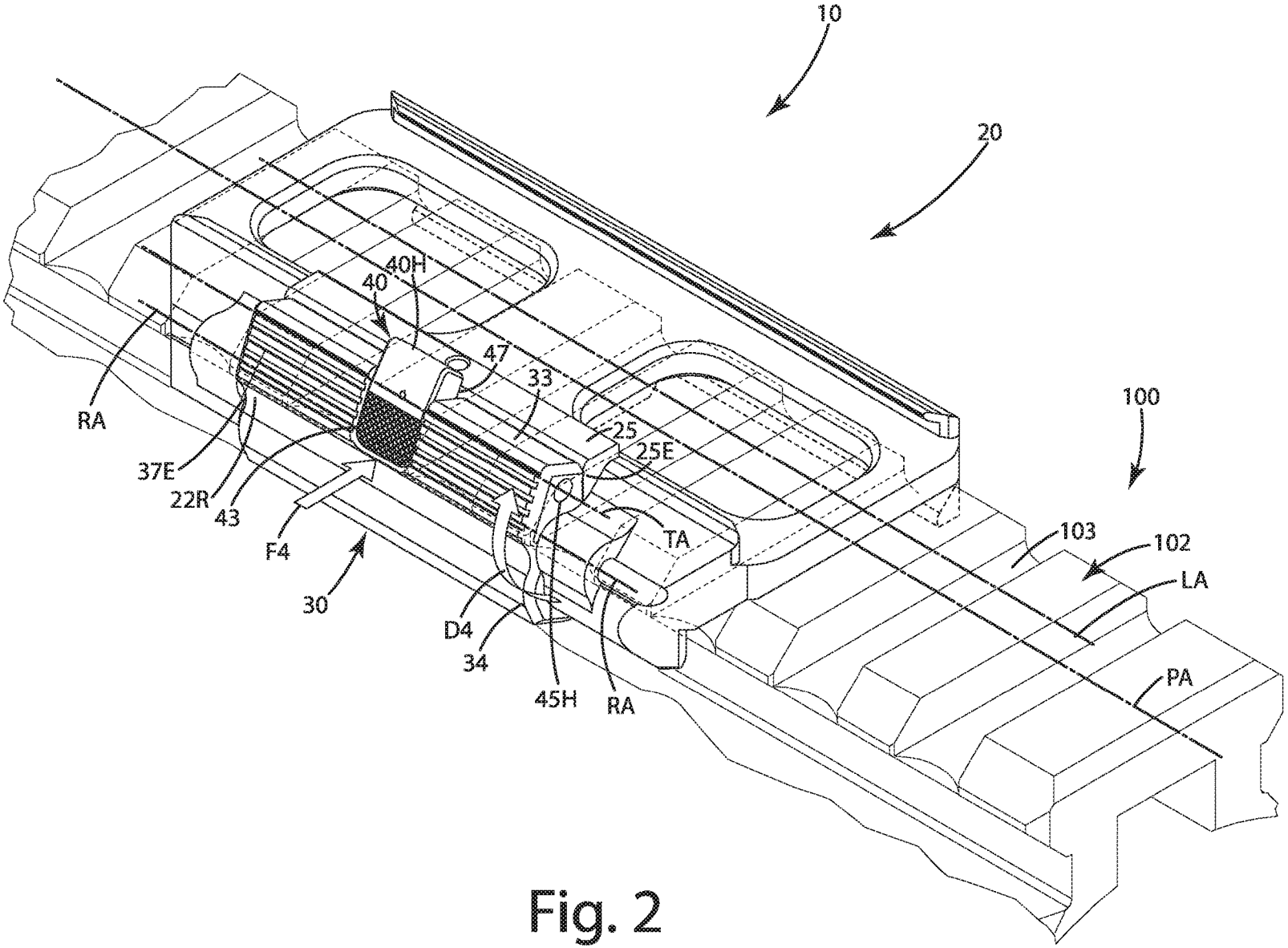
FIG. 2 is a front perspective view of the mount in an open, unlocked mode.
Figure 4:
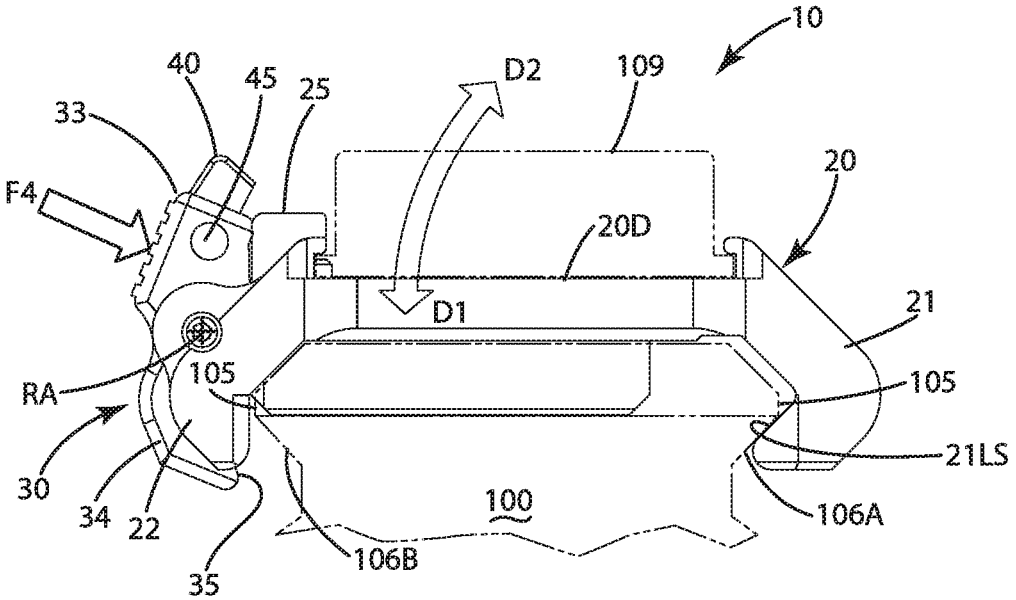
FIG. 4 is a side view of the mount in an open, unlocked mode.

As shown in FIGS. 1-3, the retention plate lower part 34 extends below the rotation axis RA. The retention plate lower part 34 can include a second undercut wall or element 35. This second undercut wall can be in the form of a surface or element that extends from the first end 31 to the second end 32 of the retention plate 30. Optionally, the wall can be interrupted, and can include groups or slots to reduce weight in certain applications. The second undercut wall 35 can be angled such that extends inward, generally toward the longitudinal axis LA. The second undercut wall 35 be configured to selectively engage the second lower inwardly extending surface 106B of the longitudinal rail 100, when the retention plate 30 is in the secure mode shown, for example in FIG. 3. When, however, the retention plate 30 is rotated about the rotational axis RA as shown in FIG. 4, the second undercut wall 35 clears and disengages the second lower surface 106B so that the retention plate 30 and that wall 35 can clear the apex 105. Thus the lateral leg 22 and the mount 10 can be moved or tilted or rotated upward in direction D2, without the retention plate 30 impairing that movement or engaging the rail to prevent removal when the plate 30 is in that release mode shown in FIG. 4.

As mentioned above, the retention plate 30 is operable in a secure mode and a release mode. The secure mode is shown in FIGS. 1, 3 and 5. There, the bias element 81, 82 urges the retention plate upper part 33 away from the buttress wall 35 and generally the base 20. As a result, the retention plate 30 is urged to rotate about the rotation axis RA. When it does, the retention plate lower part 34 is urged and moves generally toward the first undercut wall 21LS or generally toward the lateral leg 21, or more generally toward the bottom or lower part 20L. When the retention plate 30 moves in this manner, for example, in direction D3 in FIG. 1, the second undercut wall or element 35 engages against and/or contacts the second lower inwardly extending surface 106B of the longitudinal rail 100. The biasing force in direction D3 causes the first lateral leg 21 and its respective surfaces and walls to engage the first inward extending surface 106A, and/or the upper surface 104 on the opposite side of the rail 100. The bias elements 81, 82 can rotate the plate 30 so that the lower part 34 of the plate clamps against the rail 100, and in particular the second lower inwardly extending surface 106B to thereby clamp the mount 10 to the rail. In doing so, the lower undercut wall or element 35 exerts a force F3 against that second lower inwardly extending surface 106B. Accordingly, the mount 10 and the retention plate are in the secure mode. In the secure mode, the accessory 109 joined with the mount 10 is generally secured to the longitudinal rail 100 and can be utilized by user.

To convert the retention plate 30 and the mount 10 to a release mode, in which the mount and the accessory can be removed from the rail 100, the user can exert a force F4 shown in FIG. 4 against the upper part 33 of the retention plate 30, this force F4 is diverted toward the base. This in turn causes the upper part 33 to push against the bias elements and compress them. Upon compression, the upper part 33 rotates toward the buttress wall 25. The plate 30 rotates about the rotation axis RA in direction D4. The lower part 34 thus moves outward, away from the rail 100. Upon this movement, the second undercut wall or element 35 disengages the inward extending surface 106B of the rail 100. Optionally, the user can continue to push the upper part 33 until engages against the buttress wall 25. At this point, the undercut wall 35 clears the apex 105 of the rail 100.

When the retention plate 30 rotates, it rotates and moves within the recess 22R of the second lateral leg 22. When the plate 30 attains the position shown in FIG. 4, a user can continue to hold it in that position and tilt the mount 10 in a direction D2, generally rotating the mount about a point or location at or around the first undercut wall or element 21LS. The user then rotates the base 20 upward until the retention plate 30 satisfactory clears the top surface 102 of the longitudinal rail 100. The user can then remove force F4 to release the plate 30 at which point, the bias elements 81 and 82 push the upper part 33 outward and away from the buttress wall 25 and the base 20. This returns the retention plate to the secure mode, but with the mount 10 not being mounted to a rail. The user can then reconfigure or move the mount to a different location or remove it entirely from the longitudinal rail 100.

The mount 10 can include an optional toggle lock 40. This toggle lock 40 can be rotatably joined with the retention plate 30, the buttress wall 25 or a portion of the base 20. The toggle lock can be operable in at least one of an unlocked mode, shown in FIGS. 2 and 4, and a locked mode, shown in FIGS. 1 and 3. In the locked mode, the toggle lock 40 prevents the retention plate 30 from rotating about the rotation axis RA. In the unlocked mode, the toggle lock 40 does not prevent rotation of the retention plate 30 about the rotation axis RA.

More particularly, the toggle lock 40 can be joined with the retention plate 30 via a lock pin 45. The lock pin can extend through and in respective holes 45H defined by the retention plate 30, and through a hole 46H defined by the toggle lock 40. These holes can be aligned with the lock axis TA. The toggle lock 40 can rotate relative to the retention plate, and the retention plate can rotate relative to the base.

The toggle lock 40 can be joined with the retention plate upper part 33, above the second undercut wall 35 and generally above the rotation axis RA. The toggle lock can include a toggle lock head 40H that can be tilted against and engage the base, the buttress wall and/or second lateral leg to prevent the retention plate 30 from being configured in the release mode.

The toggle lock can include a toggle lock exterior surface 43 and an interior surface 47. The exterior surface 43 can be textured so that a user can engage it. The toggle lock exterior surface 43 can be substantially parallel to the retention plate exterior surface 37E when the toggle lock 40 is in the unlocked mode, for example, shown in FIG. 2. When the toggle lock 40 is in a locked mode, shown for example in FIG. 1, the toggle lock exterior surface 43 can be offset an angle A3 relative to the exterior surface 37E of the retention plate 30. The toggle lock optionally can be biased by a lock spring 42. The lock spring can engage the retention plate 30 and the toggle lock 40 to urge the toggle lock 40 to the locked mode. In this mode, the toggle lock 40 is in a position generally perpendicular to the retention plate 30. The lock spring 42 can push the toggle lock so that it is in position to engage the buttress wall 25, in particular the surface 25E, and impair rotation of the retention plate about the rotation axis RA.

Methods of using the mount 10 and joining it with a longitudinal rail 100 also are provided. To join the mount 10 and its corresponding base 20 to a rail 100, a user can place the first lateral leg 21 adjacent a first side of the longitudinal rail 100. The user can place the first undercut wall or element 21LS of the lateral leg 21 under the first lower inwardly extending surface 106A of the rail. When so placing the undercut wall or element, the lower surface 20L and/or deck 20D of the base 20 can be offset at an angle and not parallel to the upper surface 102 of the rail 100.

Thereafter, the user can move and tilt the lower surface 20L and/or deck 20D downward in direction D1 as shown in FIG. 4. While the user does this, the user can exert the force F4 on the retention plate upper part 33 so that the retention plate 30 is configured as shown in FIG. 4, in the release mode. The toggle lock also can be in the unlocked mode shown there. Optionally, when a user pushes on the lower part of the toggle lock, this converts the lock 40 to the unlocked mode. This force also converts the retention plate to the release mode, so the lock is unlocked and the retention plate is moved to the release mode. Generally, a user can unlock the toggle lock and release the retention plate with a force exerted only on the toggle lock.

The user continues to move or tilt the base 20 downward toward the top surface 102 of the rail. Where included, the slot flange 70 enters at least one of the transverse slots 103 more as the mount is tilted downward more. When the mount 10 is rotated downward, it generally has a configuration shown in FIG. 2. When the mount is in position on the rail, for example as shown in FIGS. 2 and 4, the user can then stop exerting the force F4 against the upper part and the toggle lock. When this occurs, the bias elements 81 and 82 take over and rotate the retention plate 30 about the rotation axis RA. The retention plate 30 attains the position shown in FIGS. 1 and 2. The second undercut wall or element 35 engages the second lower inwardly extending surface 106B of the longitudinal rail 100. The retention plate 30 exerts the force F3 on that wall and the rail. Accordingly, the longitudinal rail 100 is clamped between the retention plate and the first lateral leg to thereby secure the mount to the longitudinal rail 100. Where the optional toggle lock 40 is included, the lock can be rotated from the position shown in FIG. 4 to the position shown in FIG. 3 about the lock axis TA so that the toggle lock head 40H engages the surface 25E of the buttress wall 25. The toggle lock 40 is thus engaged to hold the retention plate 30 in the secure mode so the retention plate cannot disengage a longitudinal rail. The toggle lock 40 itself is placed in the locking mode to secure the retention plate, mount and the accessory joined or associated with the mount, to the rail 100. Of course where included, the lock spring can automatically move the toggle lock to the locked mode. To remove the mount and the accessory reverse process and steps can be followed.

Terms such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual elements of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A quick mount for removably attaching an accessory to a longitudinal rail, the mount comprising:

a base removably mountable on a longitudinal rail, the base including a front, a rear and downwardly extending first and second lateral legs disposed opposite one another across a longitudinal axis of the base, the first lateral leg including a first downward extending wall that transitions to a first undercut wall, the first undercut wall extending inward toward the longitudinal axis, the first undercut wall configured to engage a first lower inwardly extending surface of the longitudinal rail, the first undercut wall extending to a first lowermost surface, the second lateral leg including a second downward extending wall that extends to a second lowermost surface that is on a same level as the first lowermost surface, the second downward extending wall configured to clear an apex of the rail but not extend under a second lower inwardly extending surface of the longitudinal rail, the second lateral leg defining a plate recess between the front and the rear;

a retention plate joined with the base via a retention pivot pin, the retention plate pivotable about a rotation axis, the retention plate including a retention plate upper part located above the rotation axis and a retention plate lower part located below the rotation axis, the retention plate lower part being movably disposed in the plate recess of the second lateral leg, the retention plate lower part including a second undercut wall, the second undercut wall extending inward generally toward the longitudinal axis, the second undercut wall configured to selectively engage a second lower inwardly extending surface of the longitudinal rail;

a bias element disposed between the base and the retention plate upper part, the bias element configured to urge the retention plate upper part away from the base and around the rotation axis; and a toggle lock joined with the retention plate via a lock pin, the toggle lock pivotable about a lock axis, wherein the lock axis is substantially parallel to the rotation axis, wherein the retention plate is operable in a secure mode in which the bias element urges the retention plate lower part toward the first undercut wall so as to engage the second undercut wall against the second lower inwardly extending surface of the longitudinal rail and thereby secure the mount to the longitudinal rail, wherein the retention plate is operable in a release mode in which the bias element is alterable by a user pushing on the retention plate upper part so as to move the retention upper plate upper part toward the base so that the second undercut wall disengages the second inwardly extending surface to thereby release the mount from the longitudinal rail.

2. The quick mount of claim 1, wherein the toggle lock is positioned on the retention plate upper part above the second undercut wall, wherein the toggle lock is pivotable toward the base to engage a toggle lock head against the base to prevent the retention plate from being configurable in the release mode.

3. The quick mount of claim 2, wherein the retention plate defines a lock recess, wherein the toggle lock is rotatably disposed in the lock recess, wherein the retention plate includes a retention plate exterior surface, wherein the toggle lock includes a toggle lock exterior surface, wherein the toggle lock exterior surface is substantially parallel to the retention plate exterior surface when the toggle lock is in an unlocked mode, wherein the toggle lock exterior surface is offset at an angle relative to the retention plate exterior surface when the toggle lock is in a locked mode.

4. The quick mount of claim 1, comprising:

a toggle lock joined with the retention plate, the toggle lock pivotable about a lock axis, wherein the toggle lock is operable in at least one of an unlocked mode and a locked mode, wherein in the locked mode, the toggle lock prevents the retention plate from rotating about the rotation axis, wherein in the unlocked mode, the retention plate is free to rotate about the rotation axis.

5. The quick mount of claim 4, comprising:

a buttress wall joined with the base and located above the second lateral leg, wherein the toggle lock engages the buttress wall when in the locked mode.

6. The quick mount of claim 1, wherein the base includes a deck and a lower surface, wherein the first and second lateral legs extend downward from the lower surface, wherein the base includes a slot flange that extends downward from the lower surface between the first and second lateral legs, wherein the slot flange is configured to fit within a transverse slot defined by the longitudinal rail to prevent the base from sliding relative to the longitudinal rail.

7. A quick mount for removably attaching an accessory to a longitudinal rail, the mount comprising:

a base removably mountable on a longitudinal rail, the base including a front, a rear and downwardly extending first and second lateral legs disposed opposite one another across a longitudinal axis of the base, the first lateral leg including a first downward extending wall that transitions to a first undercut wall, the first undercut wall extending inward toward the longitudinal axis, the first undercut wall configured to engage a first lower inwardly extending surface of the longitudinal rail, the first undercut wall extending to a first lowermost surface, the second lateral leg including a second downward extending wall that extends to a second lowermost surface that is on a same level as the first lowermost surface, the second downward extending wall configured to clear an apex of the rail but not extend under a second lower inwardly extending surface of the longitudinal rail, the second lateral leg defining a plate recess between the front and the rear;

a retention plate joined with the base via a retention pivot pin, the retention plate pivotable about a rotation axis, the retention plate including a retention plate upper part located above the rotation axis and a retention plate lower part located below the rotation axis, the retention plate lower part being movably disposed in the plate recess of the second lateral leg, the retention plate lower part including a second undercut wall, the second undercut wall extending inward generally toward the longitudinal axis, the second undercut wall configured to selectively engage a second lower inwardly extending surface of the longitudinal rail;

a bias element disposed between the base and the retention plate upper part, the bias element configured to urge the retention plate upper part away from the base and around the rotation axis;

wherein the retention plate is operable in a secure mode in which the bias element urges the retention plate lower part toward the first undercut wall so as to engage the second undercut wall against the second lower inwardly extending surface of the longitudinal rail and thereby secure the mount to the longitudinal rail, wherein the retention plate is operable in a release mode in which the bias element is alterable by a user pushing on the retention plate upper part so as to move the retention upper plate upper part toward the base so that the second undercut wall disengages the second inwardly extending surface to thereby release the mount from the longitudinal rail, wherein the base defines a hole extending to the deck, wherein a plunger and a spring are disposed in the hole.

8. The quick mount of claim 7, wherein the base includes an overhang wall extending over the hole, wherein a set screw is disposed in the hole, wherein the plunger and the spring are located between the overhang wall and the set screw, wherein the plunger and spring are configured to exert a force against a pressure pad joined with the base.

9. A quick mount for removably attaching an accessory to a longitudinal rail, the mount comprising:

a base removably mountable on a longitudinal rail, the base joined with a first leg having a first undercut wall extending inward toward a longitudinal axis, the first undercut wall configured to engage a first lower inwardly extending surface of the longitudinal rail, the base joined with a second leg, opposite the first undercut wall, including a flat lower portion, the second leg defining a plate recess;

a retention plate rotatably mounted to the base, the retention plate including a retention plate upper part located above a rotation axis and a retention plate lower part located below the rotation axis, the retention plate lower part being movably disposed in the plate recess, the retention plate lower part including a second undercut wall, the second undercut wall extending inward toward the longitudinal axis, the second undercut wall configured to selectively engage a second lower inwardly extending surface of the longitudinal rail;

a bias element disposed between the retention plate and the base; and a toggle lock joined with the retention plate and rotatable about a lock axis wherein the lock axis is parallel to the rotation axis, wherein the retention plate is operable in a secure mode in which the bias element urges the retention plate lower part toward the first undercut wall so as to engage the second undercut wall against the second lower inwardly extending surface of the longitudinal rail and thereby clamp the mount to the rail, wherein the retention plate is operable in a release mode in which the bias element is alterable by a user pushing on the retention plate upper part so as to move the retention upper plate upper part toward the base so that the second undercut wall disengages the second inwardly extending surface to thereby allow the mount to release from the longitudinal rail.

10. The quick mount of claim 9, wherein the toggle lock includes a lock head configured to engage a buttress wall of the base to prevent the retention plate from rotating about the rotation axis.

11. The quick mount of claim 9, wherein the second lateral leg defines a first hole aligned with the rotation axis, wherein the retention plate defines a second hole, wherein a retention pivot pin extends within the first hole and the second hole.

12. The quick mount of claim 9, wherein the bias element is a coil spring trapped in a first spring hole defined by the retention plate and a second hole defined by the base.

13. A quick mount for removably attaching an accessory to a longitudinal rail, the mount comprising:

a base removably mountable on a longitudinal rail, the base joined with a first leg having a first undercut wall extending inward toward a longitudinal axis, the first undercut wall configured to engage a first lower inwardly extending surface of the longitudinal rail, the base joined with a second leg, opposite the first undercut wall, including a flat lower portion, the second leg defining a plate recess;

a retention plate rotatably mounted to the base, the retention plate including a retention plate upper part located above a rotation axis and a retention plate lower part located below the rotation axis, the retention plate lower part being movably disposed in the plate recess, the retention plate lower part including a second undercut wall, the second undercut wall extending inward toward the longitudinal axis, the second undercut wall configured to selectively engage a second lower inwardly extending surface of the longitudinal rail;

a bias element disposed between the retention plate and the base;

a toggle lock joined with the retention plate and rotatable about a lock axis, and a lock spring engaging the retention plate and the toggle lock to urge the toggle lock to a position that is generally perpendicular to the retention plate, wherein the retention plate is operable in a secure mode in which the bias element urges the retention plate lower part toward the first undercut wall so as to engage the second undercut wall against the second lower inwardly extending surface of the longitudinal rail and thereby clamp the mount to the rail, wherein the retention plate is operable in a release mode in which the bias element is alterable by a user pushing on the retention plate upper part so as to move the retention upper plate upper part toward the base so that the second undercut wall disengages the second inwardly extending surface to thereby allow the mount to release from the longitudinal rail.

14. The quick mount of claim 13, wherein the position enables the toggle lock to engage a buttress wall and impair rotation of the retention plate about the rotation axis.

15. The quick mount of claim 14, wherein the base includes a longitudinal axis that is generally parallel to the longitudinal rail, wherein the rotation axis is parallel to the longitudinal axis, wherein the lock axis is parallel to the longitudinal axis.

16. A quick mount for removably attaching an accessory to a longitudinal rail, the mount comprising:

a base removably mountable on a longitudinal rail, the base joined with a first leg having a first undercut wall extending inward toward a longitudinal axis, the first undercut wall configured to engage a first lower inwardly extending surface of the longitudinal rail, the base joined with a second leg, opposite the first undercut wall, including a flat lower portion, the second leg defining a plate recess;

a retention plate rotatably mounted to the base, the retention plate including a retention plate upper part located above a rotation axis and a retention plate lower part located below the rotation axis, the retention plate lower part being movably disposed in the plate recess, the retention plate lower part including a second undercut wall, the second undercut wall extending inward toward the longitudinal axis, the second undercut wall configured to selectively engage a second lower inwardly extending surface of the longitudinal rail;

a bias element disposed between the retention plate and the base;

a toggle lock joined with the retention plate and rotatable about a lock axis; and a lock spring engaging the retention plate and the toggle lock, wherein the bias element is a coil spring trapped in a first spring hole defined by the retention plate distal from the lock spring and a second hole defined by the base, wherein the retention plate is operable in a secure mode in which the bias element urges the retention plate lower part toward the first undercut wall so as to engage the second undercut wall against the second lower inwardly extending surface of the longitudinal rail and thereby clamp the mount to the rail, wherein the retention plate is operable in a release mode in which the bias element is alterable by a user pushing on the retention plate upper part so as to move the retention upper plate upper part toward the base so that the second undercut wall disengages the second inwardly extending surface to thereby allow the mount to release from the longitudinal rail.

17. A method of joining an accessory mount to a longitudinal rail defining a transverse slot, the method comprising:

providing a base including a downward extending first lateral leg and a downward extending second lateral leg;

placing a first undercut wall of the first lateral leg under a first lower inwardly extending surface of the longitudinal rail;

rotating a retention plate upper part about a rotation axis in a first direction toward the base to compress a bias element;

tilting the base so the second lateral leg moves toward a second lower inwardly extending surface of the longitudinal rail and so that a slot flange enters into a transverse slot of the longitudinal rail so that the base is un-slidable along the longitudinal rail; and releasing the retention plate upper part so that the bias element rotates the retention plate about the rotation axis in a second direction, opposite the first direction, so that a second undercut wall of the retention plate engages the second lower inwardly extending surface of the longitudinal rail; and exerting a force on a pressure pad, placed adjacent a deck of the base and between walls of the base adjacent the deck, to secure the pressure pad to the base, wherein the longitudinal rail is clamped between the retention plate and the first lateral leg to thereby secure the mount to the longitudinal rail.

18. The method of claim 17 comprising:

moving a plunger toward the pressure pad with a spring to exert the force on the pressure pad.

* * * * *